US008677898B2

(12) United States Patent
Sarnstrom

(10) Patent No.: US 8,677,898 B2
(45) **Date of Patent: *Mar. 25, 2014**

(54) ADJUSTABLE DIE FIXTURE FOR A PRINTING PRESS

(75) Inventor: Todd Sarnstrom, Ellsworth, WI (US)

(73) Assignee: Jostens, Inc., Minneapolis, MN (US)

( * ) Notice: Subject to any disclaimer, the term of this patent is extended or adjusted under 35 U.S.C. 154(b) by 133 days.

This patent is subject to a terminal disclaimer.

(21) Appl. No.: 12/041,410

(22) Filed: Mar. 3, 2008

(65) Prior Publication Data

US 2008/0202361 A1 Aug. 28, 2008

Related U.S. Application Data

(63) Continuation of application No. 10/052,034, filed on Jan. 16, 2002, now Pat. No. 7,337,721.

(51) Int. Cl.
*B41B 1/18* (2006.01)

(52) U.S. Cl.
USPC ..... 101/393; 101/391; 254/40

(58) Field of Classification Search
USPC ..... 101/393
See application file for complete search history.

(56) References Cited

U.S. PATENT DOCUMENTS

| | | | |
|---|---|---|---|
| 724,530 | A | 4/1903 | Wilson et al. |
| 921,974 | A | 5/1909 | Ginsberg |
| 1,144,458 | A | 6/1915 | Bolles |
| 1,763,090 | A | 6/1930 | Buzza |
| 1,885,958 | A | 11/1932 | Snedden |
| 2,535,725 | A | 12/1950 | Curtis |
| 2,785,629 | A | 3/1957 | Drobis |
| 3,150,582 | A | 9/1964 | Gerson |
| 3,449,971 | A | 6/1969 | Posh |
| 3,616,055 | A | 10/1971 | Mages |
| 3,832,943 | A | 9/1974 | Kirby, Jr. |
| 4,330,117 | A | 5/1982 | Weisbach |
| 4,383,760 | A | 5/1983 | Deter et al. |
| 4,512,561 | A | 4/1985 | Ury |
| 4,723,086 | A | 2/1988 | Leibovich et al. |
| 4,959,910 | A | 10/1990 | Hamilton |
| 5,000,554 | A | 3/1991 | Gibbs |
| 5,596,929 | A | 1/1997 | Fricke et al. |
| 6,598,868 | B2 | 7/2003 | Gortner |

*Primary Examiner* — Leslie J Evanisko

(74) *Attorney, Agent, or Firm* — Winthrop & Weinstine, P.A.

(57) ABSTRACT

An apparatus and methods for the adjustment of the position of a die in a printing press are disclosed. The apparatus and methods provide for the adjustment of a die frame within a chase. The chase defines a horizontal and a vertical axis. The die frame is slidably secured in a chase to permit movement and adjustment of the die frame in the horizontal and the vertical axis. The die frame may be slidably mounted to one or more vertical guides and one or more horizontal guides to facilitate movement and adjustment in the horizontal and vertical axis.

15 Claims, 3 Drawing Sheets

ADJUSTABLE DIE FIXTURE FOR A PRINTING PRESS

BACKGROUND OF THE INVENTION

1. Field of the Invention

The present invention relates generally to printing presses and, more particularly, to the adjustment of dies within a chase.

2. Description of the Related Art

The modern automatic platen press has not substantially changed since the introduction of this type of press in the early 1800's. Basically, a platen press positions a substrate or print media, such as paper, on a platen and brings the substrate into contact with a die or form to print an image on the media. In operation, a number of additional steps are also involved. Initially, the dies or forms for printing are set in a form which is secured to a back-plate to properly position the characters or images for printing. Ink is applied to the raised surface of dies or forms. These raised surfaces define the characters or image to be printed. Finally, the print media is placed on the platen, precisely aligned and brought into contact with the form or die containing the characters or image by movement of the platen toward the back-plate. As the print media is pressed between the platen and the raised surfaces of the dies or forms, the image or characters is transferred to the print media. The particular mechanisms to carry out the printing process may vary from press to press but the main components of the modern platen press are generally similar or analogous. Although, in theory, the process is relatively simple, the particular components required to carry out this process are relatively complex.

As mentioned above, the dies or forms containing the images or letters for printing are initially set in a chase or form which is secured to a back-plate to properly position the characters or images for printing. As with the overall character of the press, the methods for the precise positioning of dies and forms has also remained substantially unchanged. The dies are typically fitted within a chase or frame that is mounted to a back plate of a printing press. The die is then positioned at approximately the desired position. Furniture and coins are finally positioned around the die to bias the die within the chase. Once biased within the chase, the chase is fitted within the printing press and one or more samples are printed to gauge whether or not the die is in the proper position. If the die is properly positioned, the subject print job is commenced. If the die is not properly positioned, the chase must be removed and the die repositioned within the chase by the addition of furniture and/or the adjustment of the coins. The insertion and removal of the chase can be slow and labor intensive. Therefore, a need exists for an apparatus and methods that enable the adjustment of the position of the die within the chase without requiring removal of the chase from the press. Furthermore, the positioning of the die using furniture and coins can be cumbersome and typically requires skilled labor. Therefore, a need exists for an apparatus and methods that simplify the process of adjusting the position of the die within the chase. In addition, the positioning of the die using furniture and coins is inherently slow. Therefore, a need exists for an apparatus and methods that reduce the time required for positioning dies within a chase for printing.

SUMMARY OF THE INVENTION

The present invention meets the above described needs and provides additional improvements and advantages that will be recognized by those skilled in the art upon review of the present disclosure. In a preferred form the present invention provides an apparatus and methods for adjusting the position of a die within a chase.

The apparatus for adjusting a die of a printing press includes a chase and a die frame. The chase typically defines a vertical axis and a horizontal axis. The chase can include an upper horizontal member, a lower horizontal member, a left vertical member and a right vertical member. The members typically secured together at their ends to define the chase. The die frame is slidably secured within the chase to allow the movement of the die frame within either or both of the horizontal and the vertical axis. The die frame is generally configured to secure a die for printing. The movement within the horizontal and vertical axis permits the positioning of the die frame within the chase.

The apparatus can include one or more horizontal guides secured to the chase to which the die frame is slidably attached to permit the adjustment along the longitudinal axis of the horizontal guide. The apparatus can also include one or more vertical guides secured to the chase to which the die frame is slidably attached to permit the adjustment along the longitudinal axis of the vertical guide. The horizontal and vertical guides may be smooth rods, spirally threaded rods, or may be otherwise configured to guide the vertical and horizontal elements along their respective axis.

A vertical mount and a horizontal mount may be movably secured to the vertical guides and horizontal guides, respectively. The horizontal mount can also be secured to first ends of the vertical guides. Second ends of the vertical guides can be slidably secured to either the upper horizontal member or the lower horizontal member of the chase to permit the horizontal movement of the second ends the vertical guides along either the upper horizontal member or the lower horizontal member, respectively. The die frame can be secured to the vertical mount to slidably connect the die frame to the vertical guide. The second ends of the vertical guides may also be secured to a sliding element to slidably secure the second ends of the one vertical guides to one of the upper horizontal member and the lower horizontal member of the chase. When present, the sliding element can be securedly attached to second ends of the vertical guides and slidably attached to one of the upper horizontal member and the lower horizontal member. The vertical mount may be slidably secured to the vertical guide by mounting the vertical guide through a vertical bore in the vertical mount. Similarly, the horizontal mount may be slidably secured to the horizontal guide by mounting the horizontal guide through a horizontal bore in the horizontal mount.

A coarse vertical adjustment and a coarse horizontal adjustment can also be provided to permit the adjustment and securing of the die frame along the vertical axis and the horizontal axis, respectively. The coarse vertical adjustment can include a vertical actuator movably received within a vertical actuator receiving cavity in the vertical mount and having an at least partially threaded bore extending through the actuator. The at least partially threaded bore being coextensive with the vertical bore of the vertical mount. The at least partially threaded bore can provide the gearing relationship with the spirally threaded vertical guide. Further, the at least partially threaded bore is shaped to release the spirally threaded vertical guide when the vertical actuator is displaced relative to the vertical mount. Similarly, the coarse horizontal adjustment can include a horizontal actuator movably received within a horizontal actuator receiving cavity in the horizontal mount and having an at least partially threaded bore extending through the actuator. The at least partially threaded bore being coextensive with the horizontal bore of the horizontal mount. The at least partially threaded bore can receive the threads of the spirally threaded horizontal guide to provide the gearing relationship between the two elements. Further, the at least partially threaded bore is shaped to release the spirally threaded horizontal guide when the horizontal actuator is displaced relative to the horizontal mount. The receiving threads of the partially threaded bore biased are typically maintained in a gearing relationship with the spirally threaded vertical guide by a compressible element biased between a bottom surface of the vertical actuator and a bottom of the cavity in the vertical mount that biases the knob outward relative to the bottom of the cavity. The compressible element may be a coiled spring or other similar element. When the horizontal or vertical knobs are displaced into their respective cavities, the receiving threads of the partially threaded bores are released from their respective spirally threaded rods and the associated mounts may be moved relative to their respective spirally threaded rods.

A fine vertical adjustment and a fine horizontal adjustment can also be provided to permit the adjustment and securing of the die frame along the vertical and the horizontal axes, respectively. The fine vertical adjustment may include a spur gear and a worm gear. Similarly the fine horizontal adjustment may include a spur gear and a worm gear. The spur gear attached to the spirally threaded vertical or horizontal guide and the worm gear meshing with the spur gear such that the spur gear rotates the spirally threaded vertical or horizontal guide when the worm gear is rotated. When either the vertical or the horizontal guides are threaded, the bore receiving the threaded guide may be configured to cooperate with the respective threaded guide in a gearing relationship such that when the threaded guide is rotated the respective mount moves along the respective axis of the chase.

Figure 1:
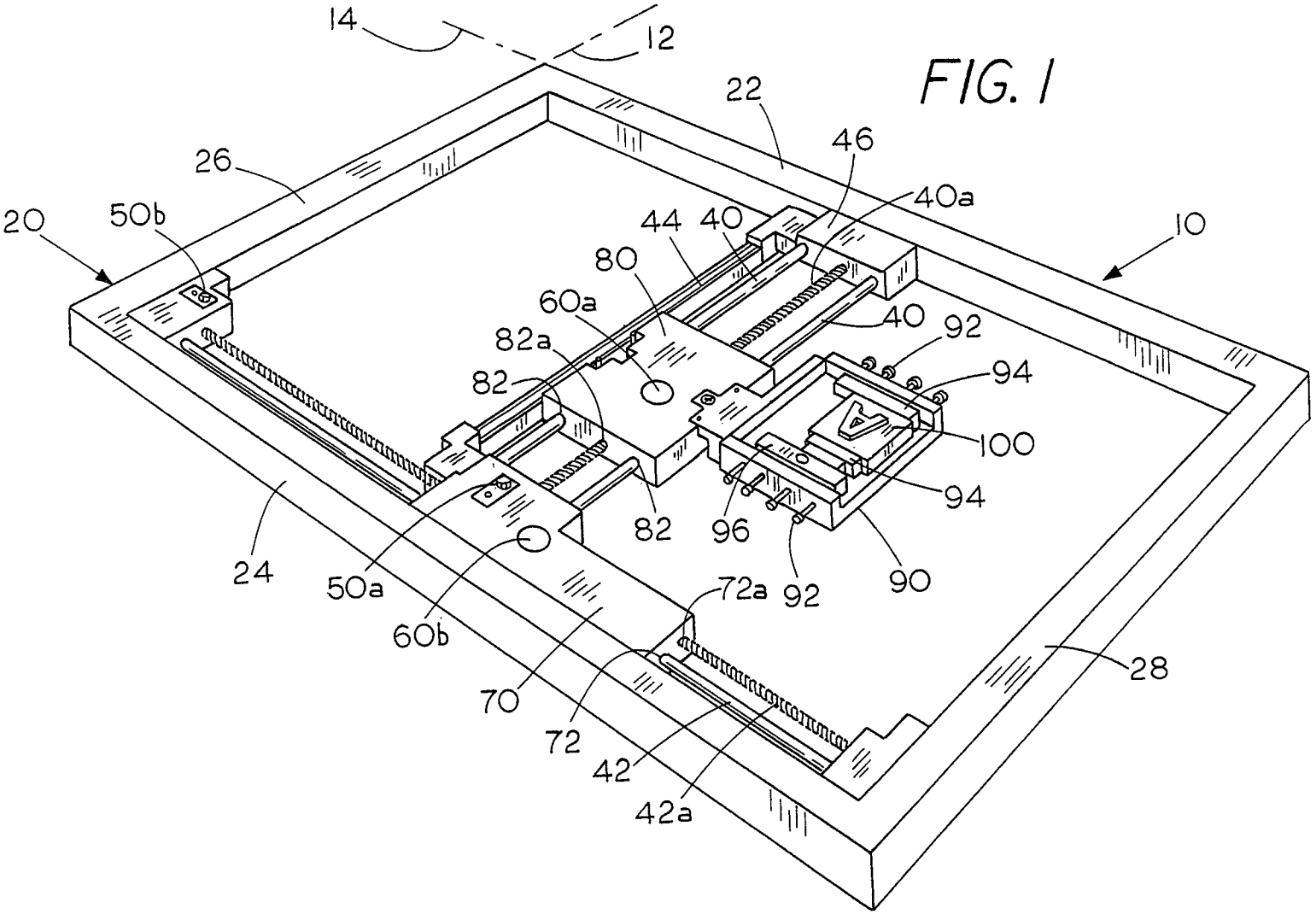
FIG. 1 illustrates a perspective view of an embodiment of an apparatus in accordance with the present invention.

All figures are drawn for ease of explanation of the basic teachings of the present invention only; the extensions of the figures with respect to number, position, relationship and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in various figures of the drawings, the same numerals designate the same or similar parts. Furthermore, when the terms "vertical," "horizontal," "top," "bottom," "right," "left," "forward," "rear," "first," "second," "inside," "outside," and similar terms are used the terms should be understood to reference only the structure shown in the drawings as it would generally appear to a person viewing the drawings and utilized only to facilitate describing the illustrated embodiment.

DETAILED DESCRIPTION OF THE PREFERRED EMBODIMENT

Figure 2:
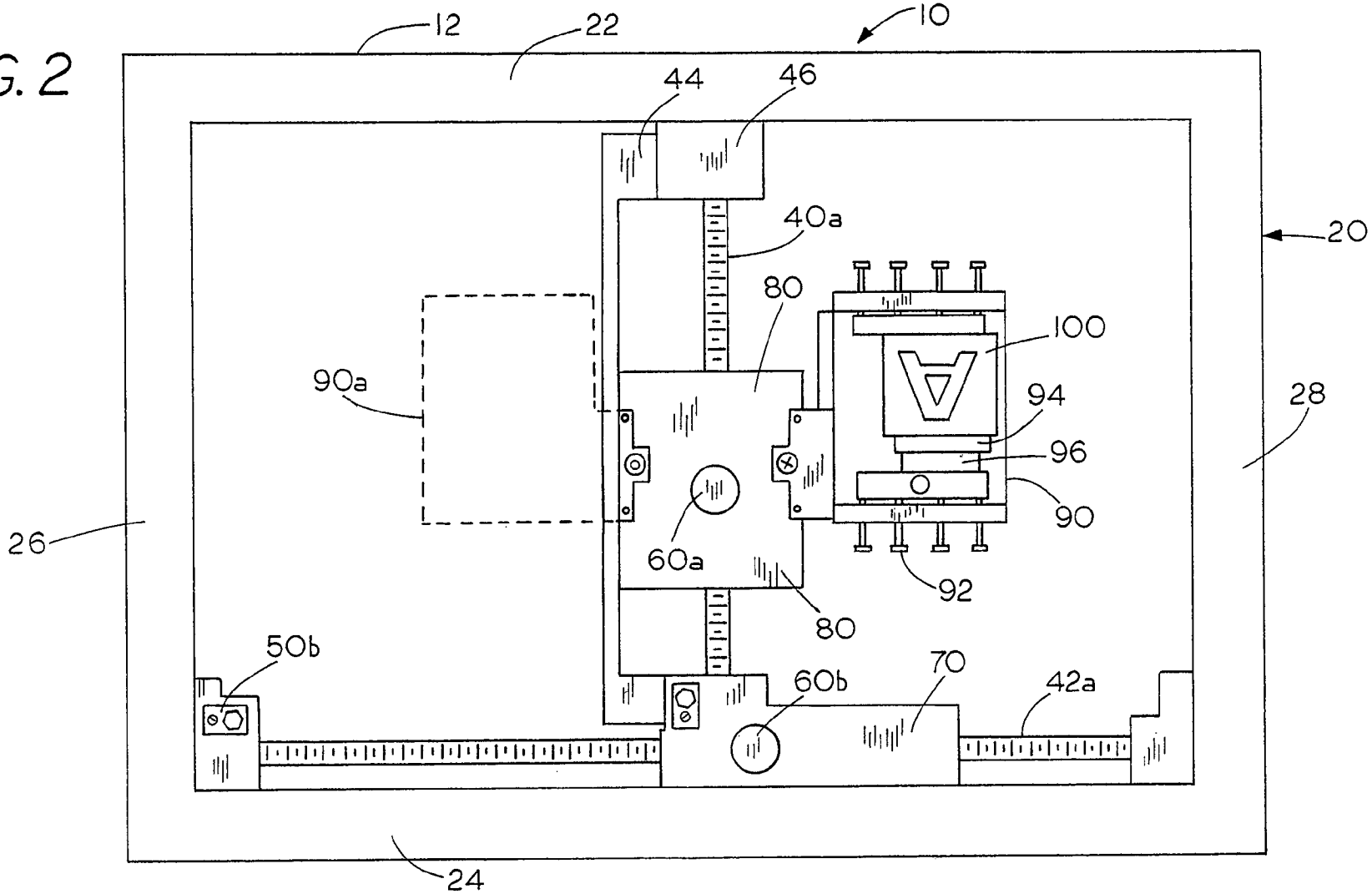
FIG. 2 illustrates a top view of another embodiment of an apparatus in accordance with the present invention.

An apparatus 10 in accordance with the present invention is generally illustrated in FIGS. 1 and 2. The apparatus 10 and methods in accordance with the present invention permit the adjustment of the position of a die 100 along horizontal and vertical axis. Apparatus 10 is generally illustrated having the size, proportions and configurations for mounting apparatus 10 in a windmill press, such as the Heidelberg "windmill" press manufactured in Germany. Upon review of the present invention, those skilled in the art will recognize modifications to the that the size, proportions and configuration to permit the use of the present invention with a variety of platen type presses, such as the Kluge Automatic Platen Press manufactured by Brandtjen and Kluge of St. Croix Falls, Wis., as well as with other presses requiring the adjustment of the die after mounting the die in the printing press.

As illustrated, apparatus 10 includes a die frame 90 slidably secured in a chase 20. A die 100 is mounted in die frame 90 to allow the imprinting of an image presented on a face of die 100. Chase 20 defines a vertical axis 12 and a horizontal axis 14. Vertical axis 12 and horizontal axis 14 generally form a plane within which the position of die 100 may be slidably adjusted. To allow the positioning of die 100 at a particular location within chase 20, die frame 90 is slidably secured within chase 20 to permit the movement along each of vertical axis 12 and horizontal axis 14.

Chase 20 is generally configured to secure apparatus 10 to a platen press, not shown, so that the image on die 100 may be impressed upon a piece of print media. Chase 20 can be composed of one or more members. As illustrated in FIGS. 1 and 2, chase 20 includes an upper horizontal member 22, a lower horizontal member 24, a left vertical member 26 and a right vertical member 28. The members may be individually connected to one another at their ends or may of unitary construction to form chase 20.

Die frame 90 is generally configured to secure a die 100 for printing. In accordance with the present invention, die frame 90 is secured to chase 20 so that the die frame may be slidably adjusted within the chase. As illustrated, die frame 90 includes a plurality of pins 92 that are threadably received within die frame 90 to secure die 100 within die frame 90. Further, as illustrated, die frame 90 includes various furniture 94 and a coin 96 to properly fit die 100 into die frame 90. Thus, in the embodiment shown, pins 92 contact furniture 94 and coin 96 to secure die 100 within die frame 90. Alternatively, pins 92-can contact die 100 directly to secure die 100 within die frame 90. In another embodiment, die frame 90 can be a peripheral frame having die 100 compressionally secured within the frame with furniture 94 and one or more coins 96 without the need for pins 92:

As illustrated in FIGS. 1 and 2 for exemplary purposes, die frame 90 can be slidably connected to one or more of vertical guides 40 and one or more horizontal guides 42. Vertical guides 40 and horizontal guides 42 may be rods, bars other elongated elements as will be recognized by those skilled in the art that may be slidably received by die frame 90 or by an element to which die frame 90 is secured, such as vertical mount 80 and horizontal mount 70 described below. Similarly, vertical guides 40 and horizontal guides 42 may have a round, oval, square, rectangular, triangular or other cross-sectional shape that facilitates the sliding movement of frame 90 within chase 20. As illustrated, die frame 90 may be slidably positioned along vertical guides 40 and horizontal guides 42 to allow the proper adjustment of die 100 for printing. In one embodiment, a vertical guide 40 and horizontal guide 42 can be a vertical spirally threaded guide 40*a* and a horizontal spirally threaded guide 42*a*. In addition, a cross-member 44 may be provided to provide additional support to apparatus 10.

As illustrated, die frame 90 is secured to a vertical mount 80. Die frame 90 is typically secured to vertical mount 80 or otherwise secured to chase 20 to permit die frame 90 to be secured and removed from chase 20 without removing apparatus 10 from the printing press. Vertical mount 80 may be configured to mount die frame 90 on a right side of vertical mount 80, vertical mount may also be configured to mount die frame 90 on a left side of vertical mount 80, as illustrated by die frame 90*a*, shown in phantom, or vertical mount 80 may be otherwise configured to mount a die frame 90 so as to permit the use of the die frame in a printing operation. Vertical mount 80 is typically slidably mounted to vertical guides 40. Vertical mount 80 includes one or more vertical bores 82 to slidably receive vertical guides 40. When apparatus 10 includes a vertical spirally threaded guide 40*a*, vertical bore 82*a* receiving the spirally threaded vertical guide 40*a* can also include threads. The threads within vertical bore 82*a* corresponding to the threads on spirally threaded vertical guide 40*a* so that vertical mount 80 is engaged in a gearing relationship with spirally threaded vertical guide 40*a* when spirally threaded vertical guide 40*a* is inserted into vertical bore 82*a*. As such, when spirally threaded vertical guide 40*a* is rotated, the threads of the threaded vertical bore 82 and the spirally threaded vertical guide 40*a* slide over one another and impart movement along the vertical axis 12 to vertical mount 80.

Similarly, die frame 90 is secured to a horizontal mount 70. Horizontal mount 70 includes one or more horizontal bores 72 to slidably receive horizontal guides 42. When apparatus 10 includes a spirally threaded horizontal guide 42*a*, horizontal bore 72*a* receiving the spirally threaded horizontal guide 40*a* can also include threads. The threads of horizontal bore 72 corresponding to the threads on spirally threaded horizontal guide 40*a* so that horizontal mount 70 is engaged in a gearing relationship with spirally threaded horizontal guide 40*a* when spirally threaded horizontal guide 40*a* is inserted into horizontal bore 72. As such, when spirally threaded horizontal guide 40*a* is rotated, the threads of the threaded bore 72 and the spirally threaded horizontal guide 40*a* slide over one another and impart movement along horizontal axis 14 to the horizontal mount 70.

As illustrated in FIGS. 1 and 2, die frame 90 is secured directly to vertical mount 80 to facilitate vertical movement for exemplary purposes. To facilitate horizontal movement, die frame 90 is secured to shown indirectly connected to horizontal mount 70, again, for exemplary purposes. As illustrated, horizontal mount securedly receives a first end of vertical guides 40 to allow the movement of the first end of vertical guides 40 in horizontal axis 14. To permit the movement of the second end of vertical guides 40, the second ends of vertical guides 40 are secured to a horizontal mount 70. Horizontal guide block 46 is movably secured to upper horizontal member 22 to slide along horizontal axis 14 parallel to upper horizontal member 22. Thus, vertical guides 40 are attached at a first end to the horizontal mount 70 and at a second end to a horizontal guide block 46 to permit the movement of vertical guides 40 along the horizontal axis. By vertical mount 80 being attached to vertical guides 40 and die frame 90 being attached or integral with vertical mount 80, die frame 90 may be moved and adjusted along horizontal axis 14. Upon review of the present disclosure, those skilled in the art will recognize additional and alternative configurations for conferring movement in the horizontal and vertical axis without departing from the scope of the present invention.

Figure 3A:
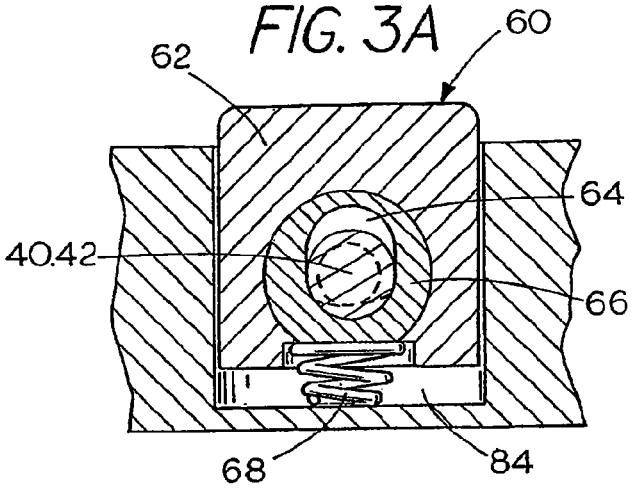
FIG. 3A illustrates a partial cross section view through line 3-3 of an embodiment of the coarse adjustment for an apparatus in accordance with the present invention with the coarse adjustment being shown in an engaged orientation.
Figure 3B:
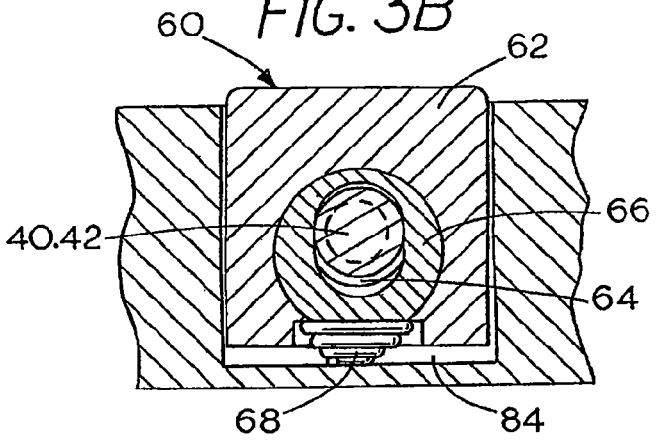
FIG. 3B illustrates a partial cross section view through line 3-3, shown in FIG. 1, of an embodiment of the coarse adjustment for an apparatus in accordance with the present invention with the coarse adjustment being shown in a disengaged orientation.

Apparatus 10 can include a coarse adjustment 60, as generally shown in FIGS. 3A, and 3B, or, more particularly, a coarse horizontal adjustment 60*a* and a coarse vertical adjustment 60*b*, as shown in FIGS. 1 and 2. The following description refers to coarse adjustment 60 generally for ease of description with the understanding a coarse adjustment may be provided for each of the horizontal and vertical axis, as shown in FIGS. 1 and 2 as coarse horizontal adjustment 60*a* and coarse vertical adjustment 60*b*, respectively, and that each may include a distinct mechanism for operation. Generally, coarse adjustment 60 locks and releases die frame 90 for adjustment along either the horizontal axis and the vertical axis. Coarse adjustment 60 is illustrated in a locked position in FIG. 3A and is illustrated in the released position in FIG. 3B. Coarse adjustment 60 includes an actuator 62, shown as a push button for exemplary purposes, having an adjustment bore 64 to receive either vertical guide 40 or horizontal guide 42 in either the threaded or non-threaded configurations. Adjustment bore 64 can be oriented through an insert 66. Insert 66 may comprise a hardened material to reduce wear from securing the threaded or non-threaded guide or may comprise a high friction material to frictionally hold threaded or non-threaded guide. Further, when insert 66 is not provide, actuator 62 can itself comprise a hardened material to reduce wear from the vertical or horizontal threaded guide or may comprise a high friction material to frictionally hold threaded or non-threaded guide. Adjustment bore 64 receives either vertical guide 40 or horizontal guide 42. Adjustment bore is generally sized to permit the horizontal or vertical guide to be positioned in an engaged and a disengaged relationship to bore 64. Typically, coarse adjustment 60 is positioned in a cavity 84 in die frame 90, vertical mount 80, or horizontal mount 70. Cavity 84 is positioned within die frame 90, vertical mount 80, or horizontal mount 70 to align adjustment bore 64 with bore 72, 72*a*, 82 or 82*a* receiving the vertical guide 40 or 40*a* or horizontal guide 42 or 42*a* to be secured by coarse adjustment 60. Actuator 62 is fitted within cavity 84 to allow movement of actuator 62 and thereby, engagement and disengagement of the respective guide passing through adjustment bore 64. To maintain actuator 62 in an engaged position, a compressible element 68 can be provided within cavity 84. As illustrated for exemplary purposes, compressible element 68 is a coiled spring. Compressible element 68 is biased between the bottom of cavity 84 and the bottom of actuator 62 to maintain a lower aspect of bore 64 in contact with guide 40, 42, as shown in FIG. 3A. When a compressing force is applied to a top surface of actuator 62, compressible element 68 is compressed and actuator 62 moves downward. The downward movement of actuator 62 alters the relationship of bore 64 and guide 40,42 to disengage guide 40,42 from bore 64, as shown in FIG. 3B. When disengaged guide 40, 42 may slide through adjustment bore 64 and also through bores 72, 72*a*, 82 and 82*a* allowing the movement of die frame 90, vertical mount 80, and/or horizontal mount 70 along the respective axis.

As illustrated for exemplary purposes, coarse adjustment 60 includes an actuator 62 having an insert 66 and a vertically elongated adjustment bore 64. Adjustment bore 64 includes a threaded lower region to engage a threaded guide 40*a* or 42*a* and a non-threaded upper region sized to permit the movement of threaded guide 40*a* or 42*a* through the upper region. As illustrated, the threads in the lower region of adjustment bore 64 comprise the entirety of the threads within vertical threaded bore 82*a* and/or horizontal threaded bore 72*a*, such that when the coarse adjustment is in the disengages position of FIG. 3B, threaded vertical guide 40*a* or threaded horizontal guide 42*a* is free to slidably move through vertical threaded bore 82*a* or horizontal threaded bore 72*a*, respectively. Thus, permitting the coarse adjustment of die frame 90 within chase 12.

Figure 4:
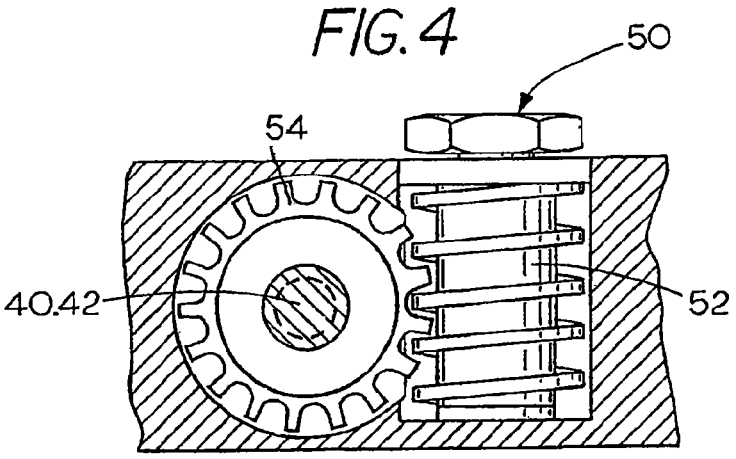
FIG. 4 illustrates a partial cross section view through section line 4-4, shown in FIG. 1, of an embodiment of the fine adjustment for an apparatus in accordance with the present invention.

Apparatus 10 can also include a fine adjustment 50, as generally shown in FIG. 4, or, more particularly, a fine horizontal adjustment 50*a* and a fine vertical adjustment 50*b*, as shown in FIGS. 1 and 2. The following description refers to fine adjustment 50 generally for ease of description with the understanding a fine adjustment may be provided for each of the horizontal and vertical axis, as shown in FIGS. 1 and 2 as fine horizontal adjustment 50*a* and fine vertical adjustment 50*b*, respectively, and that each may include a distinct mechanism for operation. Generally, fine adjustment 50 adjusts and locks die frame 90 for along either the horizontal axis and the vertical axis. Fine adjustment 50 generally includes a driving element 52 and a driven element-54. riven element 54 is secured to either a threaded vertical guide 40*a* or a threaded horizontal guide 42*a* to rotate threaded vertical guide 40*a* or a threaded horizontal guide 42*a* and thereby, finely adjust the position of die frame 90 within chase 12. Fine adjustments 50 are typically positioned proximate the end of either threaded vertical guide 40*a* or threaded horizontal guide 42*a* to permit the attachment of driven element 54 on the end of threaded vertical guide 40*a* or threaded horizontal guide 42*a*. As illustrated, fine horizontal adjustment 50*b* is positioned adjacent to left vertical member 26 of chase 12 and fine vertical adjustment 50*a* is positioned within horizontal mount 70 for exemplary purposes. The precision of the adjustment will depend on both the relationship between driving element 52 and driven element 45 as well as the pitch of the threads on threaded vertical guide 40*a* or threaded horizontal guide 42*a*.

As illustrated for exemplary purposes, driving element 52 is a worm gear in a gearing relationship and driven element 54 is a spur gear. The worm gear is engaged in a gearing relationship with the spur gear. Thus, the rotation of driving element 52 will confer a rotational movement to driven element 54. The rotation of element 54 will rotate one of threaded vertical guide 40*a* or threaded horizontal guide 42*a*. The rotation of threaded vertical guide 40*a* or threaded horizontal guide 42*a* will result in the movement of one of the die frame 90, vertical mount 80, or horizontal mount 70 along its respective axis due to the gearing relationship with the respective threaded vertical guide 40*a* or threaded horizontal guide 42*a*.

In use, a die 100 is secured in the die frame 90. The position of die 100 is then adjusted to approximately the proper position for printing using horizontal coarse adjustment 60*a* and vertical coarse adjustment 60*b* and apparatus 10 is then secured in the printing press. Alternatively, apparatus 10 is secured in the printing press and then the position of die 100 is then adjusted to approximately the proper position for printing using horizontal coarse adjustment 60*a* and vertical coarse adjustment 60*b*. Once apparatus 10 is secured in the printing press, the precise position for die 100 is determined and adjustments to the precise position of die 100 are made with horizontal fine adjustment 50*a* and vertical fine adjustment 50*b*.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An apparatus for adjusting a die of a printing press, comprising;

a chase defining a vertical axis and a horizontal axis;

a die frame arranged in the chase for holding a die in position for a press operation;

a horizontal guide extending across the chase;

a horizontal mount coarsely and finely adjustable along the horizontal guide wherein the horizontal guide extends through the horizontal mount;

a horizontal guide block slidably secured for free sliding movement along the horizontal axis of the chase;

a vertical guide extending between the horizontal mount and the horizontal guide block; and a vertical mount having first and second sides each adapted for securing the die frame thereto, the vertical mount being coarsely and finely adjustable along the vertical guide wherein the vertical guide extends through the vertical mount.

2. An apparatus, as in claim 1, the chase comprising an upper horizontal member, a lower horizontal member, a left vertical member secured to the upper horizontal member and the lower horizontal member and a right vertical member secured to the upper horizontal member and the lower horizontal member.

3. An apparatus, as in claim 1, with the at least one vertical guide comprising a spirally threaded vertical guide.

4. An apparatus, as in claim 3, further comprising a vertical fine adjustment, the vertical fine adjustment including a spur gear and a worm gear, the spur gear attached to the spirally threaded vertical guide and the worm gear meshing with the spur gear such that the spur gear rotates the spirally threaded vertical guide when the worm gear is rotated.

5. An apparatus, as in claim 3, further comprising the spirally threaded vertical guide received in a vertical bore of the vertical mount in a gearing relationship such that when the vertical spirally threaded vertical guide is rotated the vertical mount moves along the vertical axis of the chase.

6. An apparatus, as in claim 5, further comprising a fine vertical adjustment, the fine vertical adjustment including a spur gear and a worm gear, the spur gear attached to the spirally threaded vertical guide and the worm gear meshing with the spur gear such that the spur gear rotates the spirally threaded vertical guide when the worm gear is rotated.

7. An apparatus, as in claim 5, further comprising a coarse vertical adjustment, the coarse adjustment including a vertical actuator movably received within a vertical actuator receiving cavity in the vertical mount and having an at least partially threaded bore extending through the vertical actuator, the at least partially threaded bore including receiving threads and being coextensive with the vertical bore of the vertical mount, the at least partially threaded bore providing the gearing relationship with the spirally threaded vertical guide, and the at least partially threaded bore being sized to release the spirally threaded vertical guide when the vertical actuator is displaced relative to the vertical mount.

8. An apparatus, as in claim 7, further comprising the receiving threads of the partially threaded bore biased in a gearing relationship with the spirally threaded vertical guide by a compressible element biased between a bottom surface of the vertical actuator and a bottom of the cavity in the vertical mount.

9. An apparatus, as in claim 8, with the compressible element comprising a coiled spring.

10. An apparatus, as in claim 1, with at least one of the at least one horizontal guide comprising a spirally threaded horizontal guide.

11. An apparatus, as in claim 10, further comprising the spirally threaded horizontal guide received in a horizontal bore of the horizontal mount in a gearing relationship such that when the spirally threaded horizontal guide is rotated, the horizontal mount moves along the horizontal axis of the chase.

12. An apparatus, as in claim 11, further comprising a fine horizontal adjustment, the fine horizontal adjustment including a spur gear attached the spirally threaded horizontal guide, and a worm gear, with the worm gear meshing with the spur gear such that, when the worm gear is rotated, the spur gear rotates the spirally threaded horizontal guide to move the horizontal mount along the horizontal axis of the chase.

13. An apparatus, as in claim 11, further comprising a coarse horizontal adjustment, the coarse adjustment including a horizontal actuator movably received within a horizontal actuator receiving cavity in the horizontal mount and having an at least partially threaded bore extending through the actuator, the at least partially threaded bore including receiving threads and being coextensive with the horizontal bore of the horizontal mount, the at least partially threaded bore providing the gearing relationship with the spirally threaded horizontal guide, and the at least partially threaded bore being sized to release the spirally threaded vertical guide when the horizontal actuator is displaced relative to the horizontal mount.

14. An apparatus, as in claim 13, further comprising the receiving threads of the partially threaded bore biased in a gearing relationship with the spirally threaded horizontal guide by a compressible element biased between a bottom surface of the horizontal actuator and a bottom of the cavity in the horizontal mount.

15. An apparatus, as in claim 14, with the compressible element comprising a coiled spring.

* * * * *